US007134839B2

(12) United States Patent
Horng et al.

(10) Patent No.: US 7,134,839 B2
(45) Date of Patent: Nov. 14, 2006

(54) RADIAL-FLOW HEAT-DISSIPATING FAN WITH INCREASED INLET AIRFLOW

(75) Inventors: Alex Horng, Kaohsiung (TW); Yu-Yuan Lu, Kaohsiung (TW)

(73) Assignee: Sunonwealth Electric Machine Industry Co., Ltd., Kaohsiung (TW)

( * ) Notice: Subject to any disclaimer, the term of this patent is extended or adjusted under 35 U.S.C. 154(b) by 186 days.

(21) Appl. No.: 10/889,086

(22) Filed: Jul. 13, 2004

(65) Prior Publication Data

US 2005/0265832 A1 Dec. 1, 2005

(51) Int. Cl.
*F04D 17/02* (2006.01)

(52) U.S. Cl. ..... 415/199.4; 415/206; 416/175; 416/198 R; 416/203

(58) Field of Classification Search ..... 415/62, 415/66, 98, 99, 102, 103, 213.1, 199.4, 206; 416/124, 125, 175, 185, 198 R, 203
See application file for complete search history.

(56) References Cited

U.S. PATENT DOCUMENTS 902,533 A * 10/1908 Hubbard ..... 415/199.6
6,457,955 B1 * 10/2002 Cheng ..... 417/423.8
7,008,189 B1 * 3/2006 Jarrah et al. ..... 416/175

FOREIGN PATENT DOCUMENTS

JP 52016010 A * 2/1977
TW 387512 4/2000

* cited by examiner

*Primary Examiner*—Ninh H. Nguyen
(74) *Attorney, Agent, or Firm*—Bacon & Thomas, PLLC

(57) ABSTRACT

A radial-flow heat-dissipating fan includes a casing and a cover mounted to a side of the casing. The casing includes a compartment and a side air outlet, and the cover includes an air inlet. A primary fan wheel is rotatably mounted in the compartment and the primary fan wheel includes a hub and a plurality of radial-flow blades surrounding the hub. An auxiliary fan wheel is mounted in the air inlet of the cover and includes a plurality of axial-flow blades. An airflow transition area is defined between a circumference of the hub of the primary fan wheel, the radial-flow blades, and the axial-flow blades. The axial-flow blades increase axial inlet airflow via the air inlet, with the airflow transition area changing a direction of the axial inlet airflow into centrifugal airflow that is outputted via the side air outlet by the radial-flow blades.

17 Claims, 7 Drawing Sheets

RADIAL-FLOW HEAT-DISSIPATING FAN WITH INCREASED INLET AIRFLOW

BACKGROUND OF THE INVENTION

1. Field of the Invention

The present invention relates to a radial-flow heat-dissipating fan. In particular, the present invention relates to a radial-flow heat-dissipating fan with increased inlet airflow.

2. Description of Related Art

FIG. 1 of the drawings illustrates a conventional radial-flow heat-dissipating fan comprising a casing 1, a cover 2, and a fan wheel 3. The casing 1 includes a compartment 11 and a side air outlet 12. The cover 2 is attached to the casing 1 and includes an air inlet 21. The fan wheel 3 is rotatably received in the compartment 11 and includes a hub 31, an annular plate 32, and a plurality of blades 33. In operation, the blades 33 are turned to draw axial airflow via the air inlet 21 of the cover 2. The airflow exits the side air outlet 12 of the casing 1 for dissipating heat from an object. The amount of inlet air is limited, as only one fan wheel 3 is used. The outlet air amount and the wind pressure are relatively low.

Taiwan Utility Model Publication No. 387512 discloses a radial-flow heat-dissipating fan comprising a primary fan wheel that includes a hub, an annular plate extending from the hub, and a plurality of blades on the annular plate. Further, a guiding fan wheel is securely mounted around a hub of the fan wheel and includes a plurality of blades close to the annular plate of the primary fan wheel. In operation, the guiding fan wheel turns together with the primary fan wheel, with the blades of the guiding fan wheel increasing air inlet amount, thereby increasing wind pressure and increasing air outlet amount. However, since the blades of the guiding fan wheel are almost in contact with the annular plate of the primary fan wheel and away from the air inlet, the inlet airflow is only increased by a relatively small amount via the air inlet. Further, since the direction of the axial inlet airflow could not be changed in time, the inlet airflow directly impinges the annular plate of the primary fan wheel, resulting in turbulent and noise. Further, since the blades of the guiding fan wheel are close to the blades of the primary fan wheel and thus block a portion of the blades of the primary fan wheel, the blowing efficiency of the blades of the primary fan wheel could not reach the expected result.

OBJECTS OF THE INVENTION

An object of the present invention is to provide a radial-flow heat-dissipating fan comprising a primary fan wheel and at least one auxiliary fan wheel for increasing inlet airflow and increasing output wind pressure.

Another object of the present invention is to provide a radial-flow heat-dissipating fan comprising a primary fan wheel and at least one auxiliary fan wheel for smoothly changing output direction of airflow, thereby lowering blowing noise.

SUMMARY OF THE INVENTION

In accordance with an aspect of the present invention, a radial-flow heat-dissipating fan comprises a casing and a cover mounted to a side of the casing. The casing includes a compartment and a side air outlet, and the cover includes an air inlet. A primary fan wheel is rotatably mounted in the compartment and the primary fan wheel includes a hub and a plurality of radial-flow blades surrounding the hub of the primary fan wheel.

An auxiliary fan wheel is mounted in the air inlet of the cover and includes a plurality of axial-flow blades. An airflow transition area is defined between a circumference of the hub of the primary fan wheel, the radial-flow blades of the primary fan wheel, and the axial-flow blades of the auxiliary fan wheel. The axial-flow blades of the auxiliary fan wheel increase axial inlet airflow via the air inlet, with the airflow transition area changing a direction of the axial inlet airflow into centrifugal airflow that is outputted via the side air outlet by the radial-flow blades of the primary fan wheel.

In an embodiment of the invention, the primary fan wheel and the auxiliary fan wheel are driven by a common motor. The hub of the auxiliary fan wheel includes a shaft-receiving hole, and the primary fan wheel includes a shaft extending through a top face of the hub of the primary fan wheel into the shaft-receiving hole.

In another embodiment of the invention, the hub of the primary fan wheel includes a reduced section, and the hub of the auxiliary fan wheel includes a coupling section engaged with the reduced section.

In an embodiment of the invention, an annular wall is formed on a side of the cover and extends from a periphery delimiting the air inlet. The auxiliary fan wheel is mounted in the annular wall.

The primary fan wheel includes an annular plate extending from the hub, and the radial-flow blades of the primary fan wheel are provided on a side of the annular plate. A first guiding face is formed in a jointing area between the hub and the annular plate. A second guiding face is formed in a jointing area between a circumference of the hub and a top face of the hub. A bottom of the hub of the auxiliary fan wheel is in contact with the top face of the hub of the primary fan wheel, with the axial-flow blades of the auxiliary fan wheel facing the guiding face.

In another embodiment of the invention, the axial-flow blades of the auxiliary fan wheel extend outward from a top face of the hub of the auxiliary fan wheel to a circumference of the hub of the auxiliary fan wheel.

In a further embodiment of the invention, the annular plate includes a plurality of openings, leaving a plurality of ribs. A portion of incoming axial inlet airflow passes through the openings to cool the motor for driving the primary fan wheel.

In still another embodiment of the invention, the primary fan wheel and the auxiliary fan wheel are respectively driven by two motors.

The cover includes a plurality of ribs extending into the air inlet for supporting a base to which the motor for driving the auxiliary fan wheel is mounted.

In an alternative embodiment, the cover includes a plurality of ribs extending into the casing for supporting a base to which the motor for driving the auxiliary fan wheel is mounted.

In yet another embodiment of the invention, a second cover and a second auxiliary fan wheel are mounted to the other side of the casing. The second cover includes an air inlet. The second auxiliary fan wheel includes a plurality of axial-flow blades. The primary fan wheel including an annular plate extending from a circumference of the hub and separate the axial-flow blades of the auxiliary fan wheel from the axial-flow blades of the second auxiliary fan wheel. The radial-blades of the primary fan wheel are formed on a side of the annular plate. A plurality of second radial-blades are formed on the other side of the annular plate of the primary fan wheel.

A third guiding face is formed in a jointing area between the hub of the second auxiliary fan wheel and the annular plate of the primary fan wheel. The second cover includes an annular wall formed on a side thereof and extending from a periphery delimiting the air inlet of the second cover. The second auxiliary fan wheel is received in the annular wall on the second cover.

In accordance with the radial-flow heating-dissipating fan of the present invention, the overall air inlet amount is increased, the direction of the incoming airflow is smoothly changed, and the blowing noise is lowered. Further, the output wind pressure is increased and the heat-dissipating efficiency is thus improved.

Other objects, advantages and novel features of this invention will become more apparent from the following detailed description when taken in conjunction with the accompanying drawings.

DETAILED DESCRIPTION OF THE PREFERRED EMBODIMENTS

Figure 1:
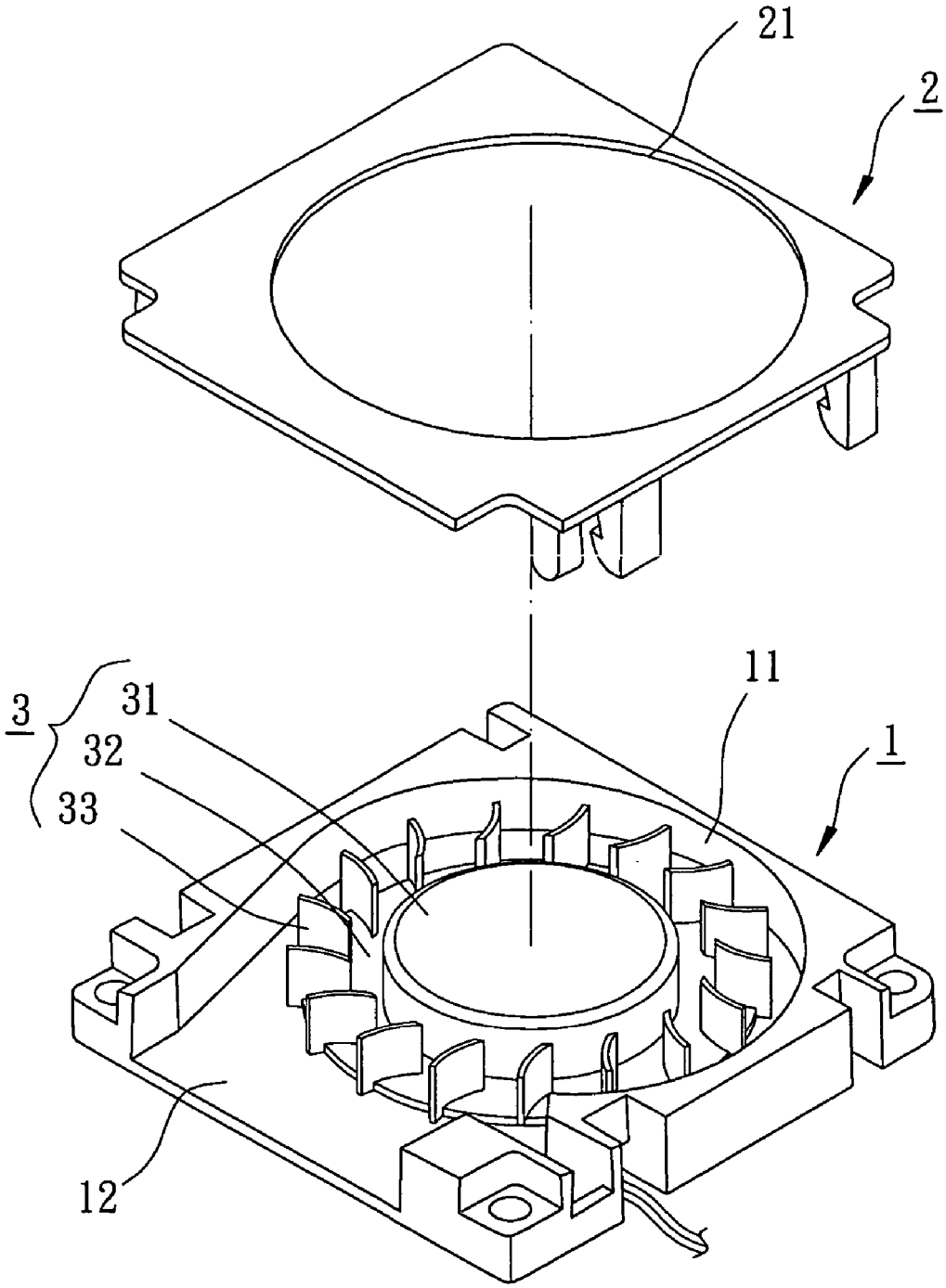
FIG. 1 PRIOR ART
FIG. 1 is an exploded perspective view of a conventional radial-flow heat-dissipating fan.

Preferred embodiments of the present invention are now to be described hereinafter in detail, in which the same reference numerals are used in the preferred embodiments for the same parts as those in the prior art to avoid redundant description.

Figure 2:
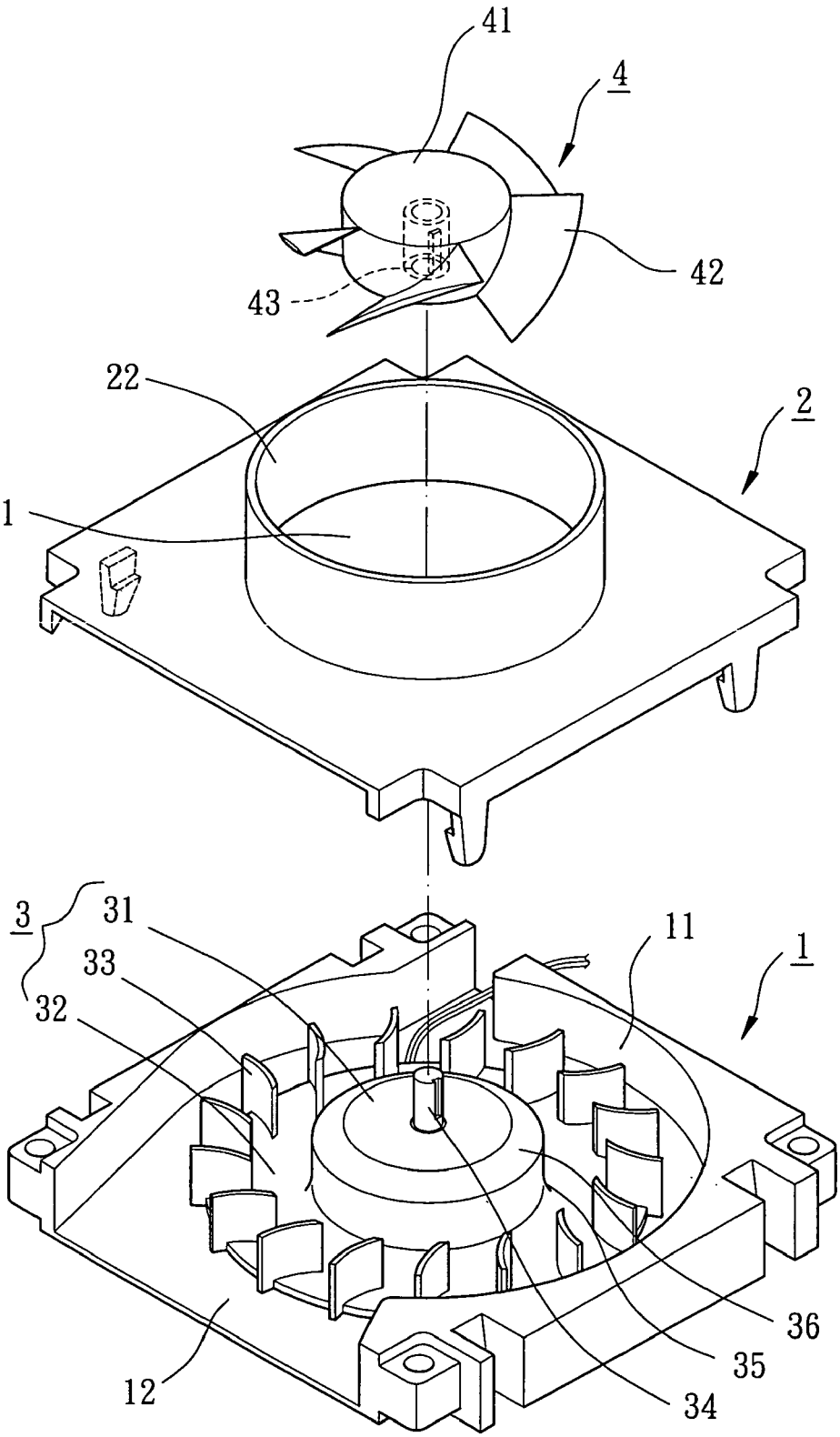
FIG. 2 is an exploded perspective view of a first embodiment of a radial-flow heat-dissipating fan in accordance with the present invention.
Figure 3:
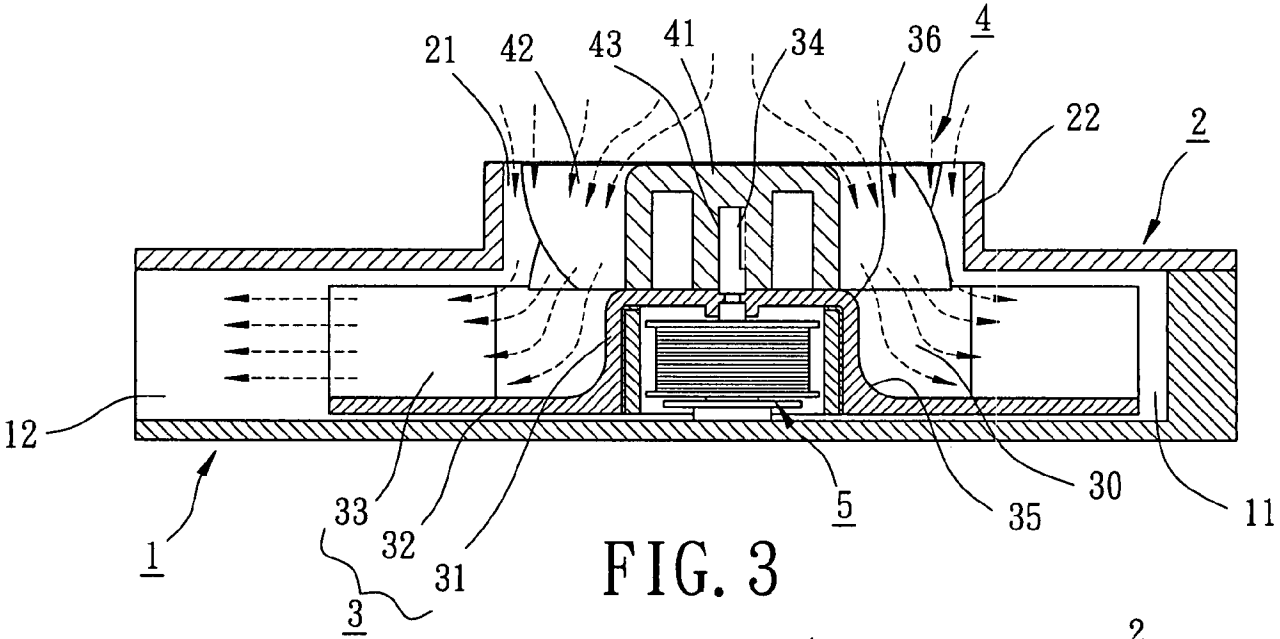
FIG. 3 is a sectional view of the first embodiment in accordance with the present invention.

Referring to FIGS. 2 and 3, a first embodiment of a radial-flow heat-dissipating fan in accordance with the present invention comprises a casing 1, a cover 2, a primary fan wheel 3, an auxiliary fan wheel 4, and an airflow transition area 30. The casing 1 includes a compartment 11 for rotatably receiving the primary fan wheel 3 and a side air outlet 12 that is communicated with the compartment 11 and outputs centrifugal airflow. The cover 2 is mounted to a side of the casing 1 and includes an air inlet 21. Preferably, an annular wall 22 is formed on a side of the cover 2 and extends from a periphery delimiting the air inlet 21.

The primary fan wheel 3 includes a hub 31, an annular plate 32 extending from the hub 31, and a plurality of radial-flow blades 33 formed on a side of the annular plate 32. A motor 5 is mounted inside the hub 31 and includes a shaft 34 extending beyond the hub 31. The motor 5 further includes a first guiding face 35 and a second guiding face 36. The first guiding face 35 is arcuate and formed in a jointing area between the hub 31 and the annular plate 32 of the primary fan wheel 32. The second guiding face 36 is also arcuate and formed in a jointing area between a top face of the hub 31 and a circumference of the hub 31.

Still referring to FIGS. 2 and 3, the auxiliary fan wheel 4 is mounted in the annular wall 22 extending from the cover 2. The auxiliary fan wheel 4 includes a hub 41, a plurality of axial-flow blades 42, and a shaft-receiving hole 43 for receiving the protruded portion of the shaft 34. After assembly, a bottom of the hub 41 of the auxiliary fan wheel 4 is in contact with the top face of the hub 31 of the primary fan wheel 3, with the axial-flow blades 42 of the auxiliary fan wheel 4 facing the second guiding face 36 of the primary fan wheel 3. The axial-flow blades 42 of the auxiliary fan wheel 4 are at an axial position different from that of the radial-flow blades 33 of the primary fan wheel 3. An airflow transition area 30 is defined between the axial-flow fan blades 42, the radial-flow fan blades 33, the annular plate 32, the first guiding face 35, and the second guiding face 36.

As illustrated in FIG. 3, in operation, the auxiliary fan wheel 4 is synchronously turned when the primary fan wheel 3 is driven by the motor 5. The axial-flow blades 42 of the auxiliary fan wheel 42 increase the axial inlet airflow (i.e., the air inlet amount) via the air inlet 21. The incoming axial airflow from the air inlet 21 enters the airflow transition area 30, with its direction being smoothly changed with the aid from the first and second guiding faces 35 and 36. In other words, the axial airflow turns into centrifugal airflow after passing through the airflow transition area 30. The centrifugal airflow is driven by the axial-flow blades 33 of the primary fan wheel 3 and pressurized in the compartment 11 and then outputted via the side air outlet 12. With the arrangement of the auxiliary fan wheel 4 and the airflow transition area 30, the overall air inlet amount is increased, the direction of the incoming airflow is smoothly changed, and the blowing noise is lowered. Further, since airflow of a large amount is driven and pressurized in the compartment 11, the output wind pressure is increased, thereby improving the heat-dissipating efficiency.

Figure 4:
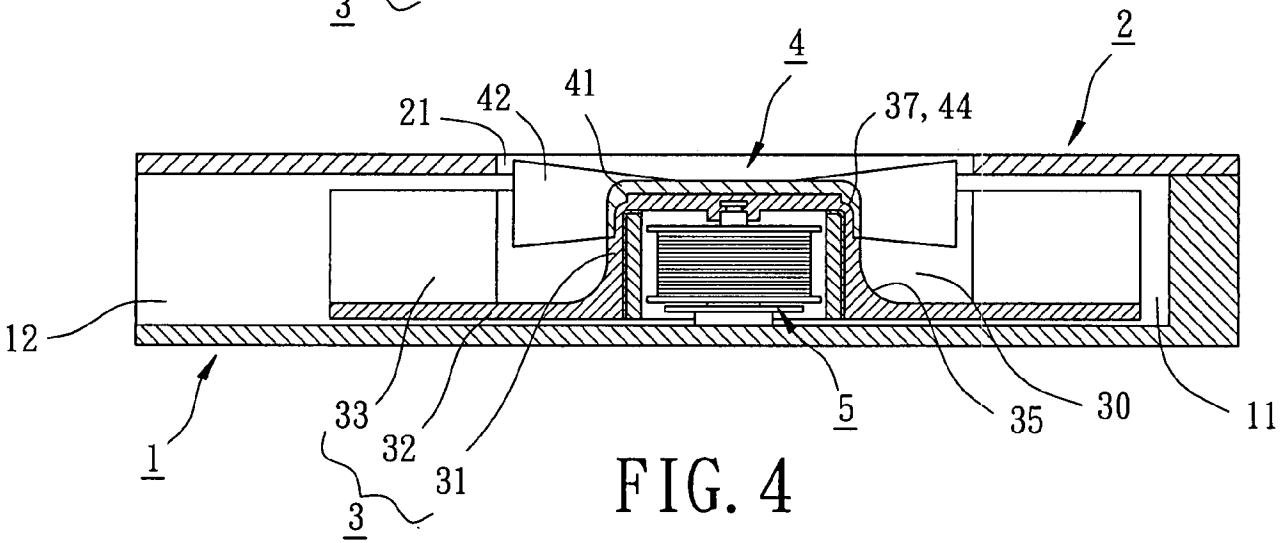
FIG. 4 is a sectional view illustrating a second embodiment of the radial-flow heat-dissipating fan in accordance with the present invention.

FIG. 4 illustrates a second embodiment of the present invention, wherein the hub 31 of the primary fan wheel 3 includes a reduced section 37, and the hub 41 of the auxiliary fan wheel 4 includes a coupling section 44 engaged with the reduced section 37 by means of bonding, screwing, welding, snapping, or force-fitting. Further, the axial-flow blades 42 of the auxiliary fan wheel 4 extend outward from a top face of the hub 41 to a circumference of the hub 41. The axial-flow blades 42 of the auxiliary wheel 4 is at an axial height not higher than that of the cover 2. Still, an airflow transition area 30 is defined between the axial-flow fan blades 42, the radial-flow fan blades 33, the annular plate 32, the first guiding face 35, and the second guiding face 36. Similar to the above embodiment, the overall air inlet amount is increased, the direction of the incoming airflow is smoothly changed, and the blowing noise is lowered. Further, the output wind pressure is increased and the heat-dissipating efficiency is thus improved.

Figure 5:
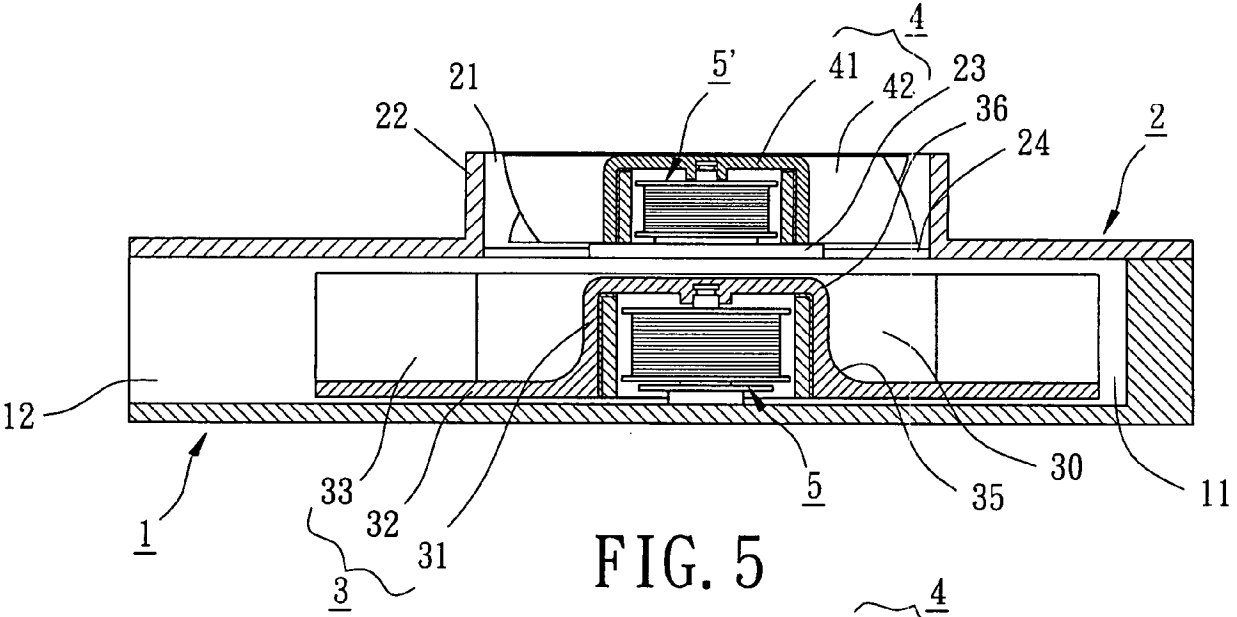
FIG. 5 is a sectional view illustrating a third embodiment of the radial-flow heat-dissipating fan in accordance with the present invention.

FIG. 5 illustrates a third embodiment of the present invention, wherein the auxiliary fan wheel 4 is driven by a motor 5' separate from the motor 5 for driving the primary fan wheel 3. The cover 2 includes a base 23 and a plurality of ribs 24 in the air inlet 21. The auxiliary fan wheel 4 is mounted in the annular wall 22 of the cover 2, with the base 23 being supported by the ribs 24 to allow coupling of the motor 5' and the auxiliary fan wheel 4 with the base 23. The motors 5 and 5' can be controlled to turn at different speeds according to different heat-dissipating needs. Thus, the air inlet efficiency of the auxiliary fan wheel 4 and the air outlet efficiency of the primary fan wheel 3 can be adjusted. For example, in a case that the speed of the auxiliary fan wheel 4 is higher than that of the primary fan wheel 3, the axial-flow blades 42 of the auxiliary fan wheel 4 can be used to drive more axial airflow into the airflow transition area 30, and the radial-flow blades 33 of the primary fan wheel 3 can create greater wind pressure and output more airflow via the side air outlet 12, improving the overall heat-dissipating efficiency.

Figure 6:
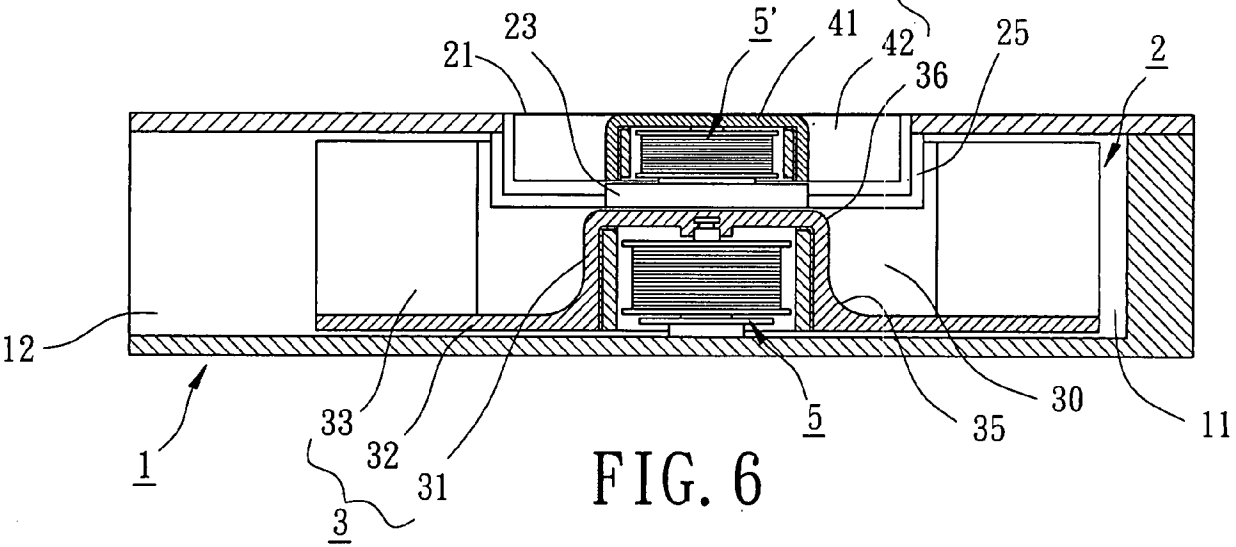
FIG. 6 is a sectional view illustrating a fourth embodiment of the radial-flow heat-dissipating fan in accordance with the present invention.

FIG. 6 illustrates a fourth embodiment of the present invention, wherein the auxiliary fan wheel 4 is driven by a motor 5' separate from the motor 5 for driving the primary fan wheel 3, similar to the third embodiment. Further, the annular wall 22 in the third embodiment is omitted. Instead, the cover 2 includes a plurality of ribs 25 extending into the casing 11. The motor 5' is mounted on a base 23 that is supported by the ribs 25. A portion of each axial-flow blade 42 of the auxiliary fan wheel 4 is at least partially located in the air inlet 21 of the cover 2. The motors 5 and 5' can be controlled to turn at different speeds to change the air inlet efficiency of the auxiliary fan wheel 4 and the air outlet efficiency of the primary fan wheel 3.

Figure 7:
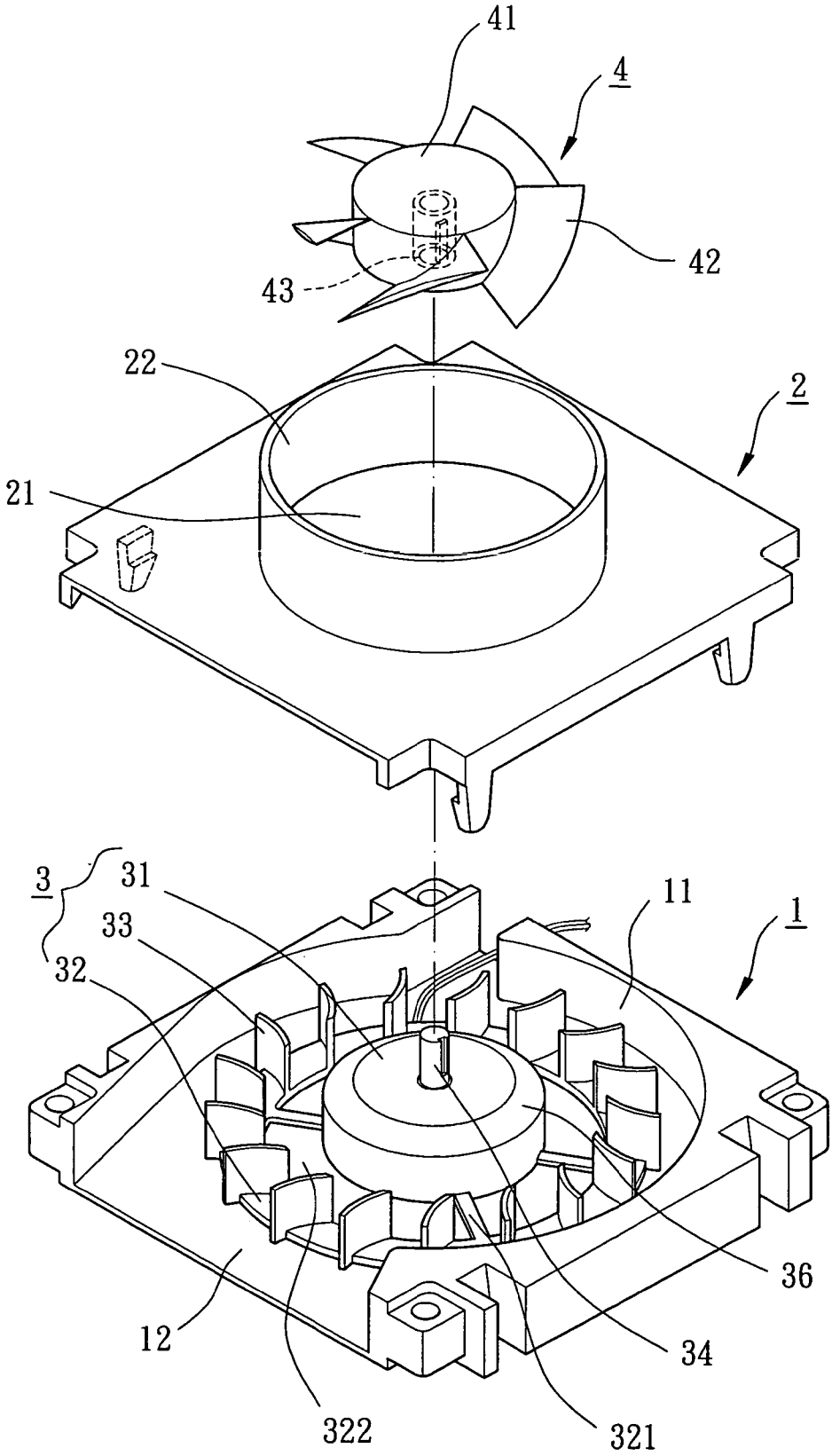
FIG. 7 is an exploded perspective view of a fifth embodiment of the radial-flow heat-dissipating fan in accordance with the present invention.
Figure 8:
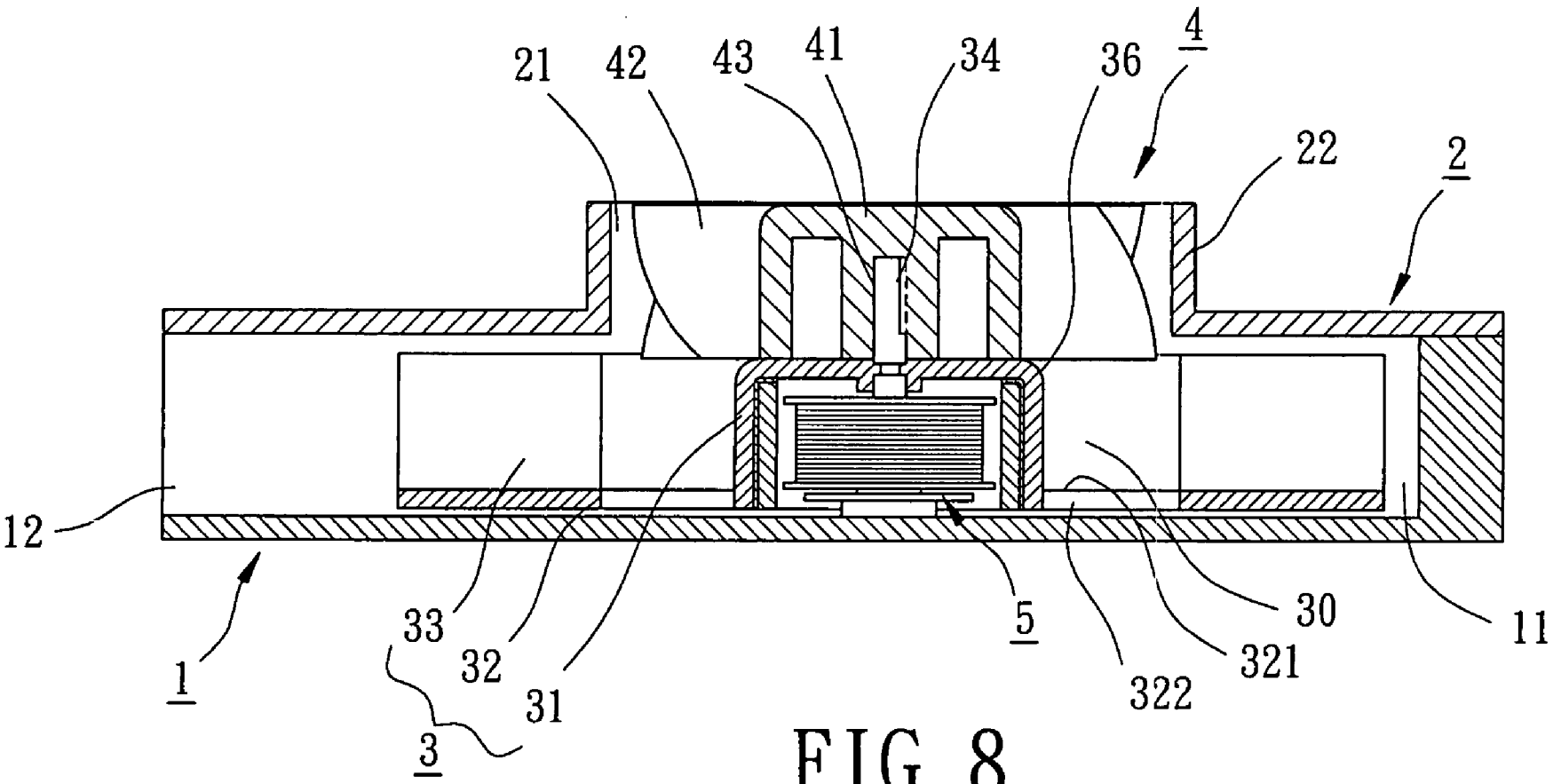
FIG. 8 is a sectional view of the fifth embodiment in accordance with the present invention.

FIGS. 7 and 8 illustrate a fifth embodiment of the present invention, wherein the annular plate 32 includes a plurality of annularly spaced openings 322, leaving a plurality of ribs 321. Still, an airflow transition area 30 is defined between the axial-flow fan blades 42, the radial-flow fan blades 33, the annular plate 32, the first guiding face 35, and the second guiding face 36. When the auxiliary fan wheel 4 draws axial airflow, a portion of the incoming axial airflow passes through the openings 322 to cool the motor 5 in the primary fan wheel 3, reducing the risk of burning down of the motor 5 due to overheating.

Figure 9:
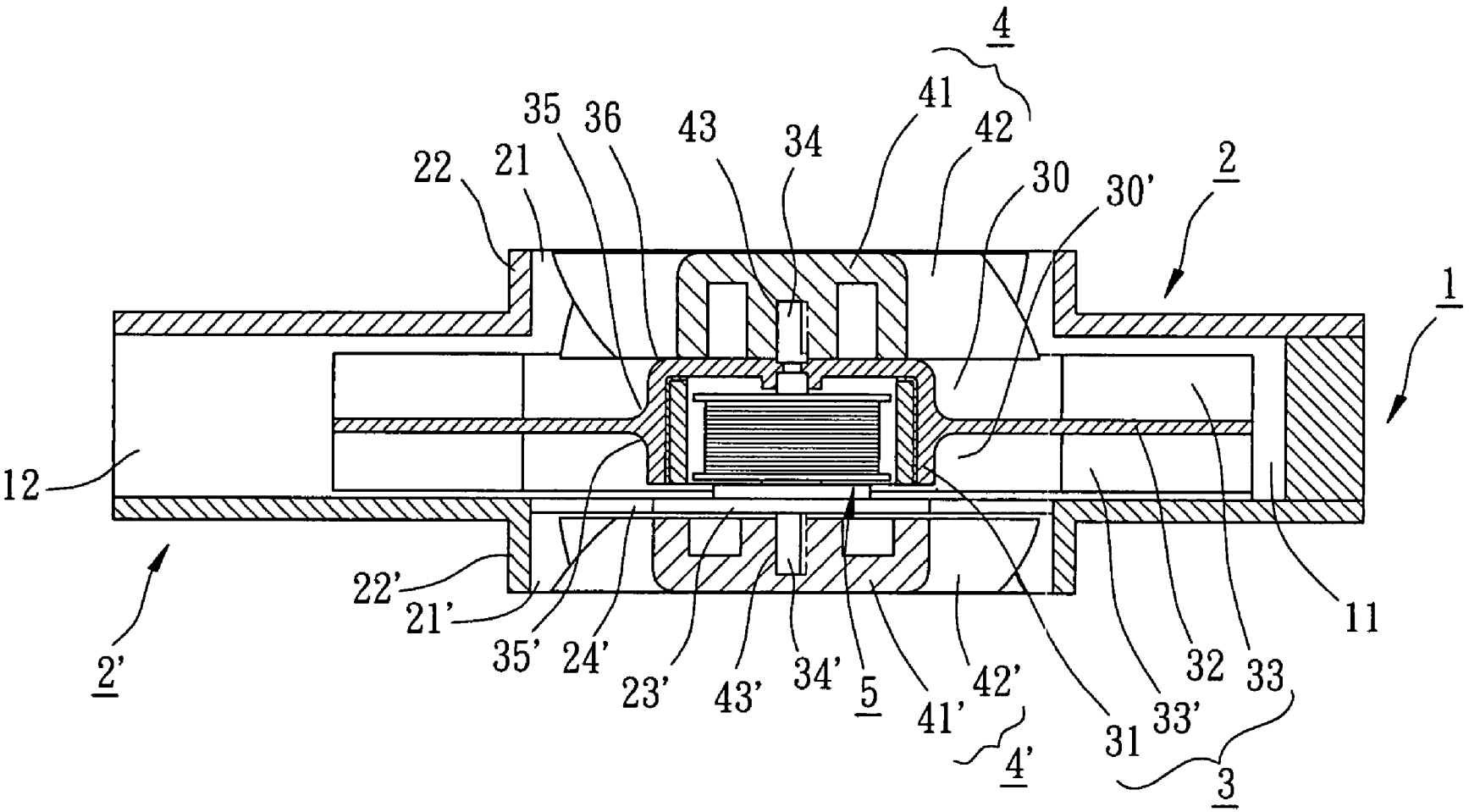
FIG. 9 is a sectional view illustrating a sixth embodiment of the radial-flow heat-dissipating fan in accordance with the present invention.

FIG. 9 illustrates a sixth embodiment of the present invention that is modified from the first embodiment, wherein an additional cover 2' and an additional auxiliary fan wheel 4' are mounted to the other side of the casing 1. Further, the primary fan wheel 3 includes a plurality of axial-flow blades 33' on the other side of the annular plate 32. The cover 2' includes an air inlet 21', an annular wall 22', a base 23', and a plurality of ribs 24'. The motor 5 for driving the primary fan wheel 3 is mounted on the base 23'. A third guiding face 35' is formed in a jointing area between the hub 31 of the primary fan wheel 3 and the second side of the annular plate 32.

The auxiliary fan wheel 4' includes a hub 41', a plurality of axial-flow fan blades 42', and a shaft-receiving hole 43'. The shaft 34 includes an extension 34' extending into the shaft-receiving hole 43' of the auxiliary fan wheel 4'. An airflow transition area 30' is defined between the axial-flow blades 42', the annular plate 32, and the third guiding face 35'.

In operation, the primary fan wheel 3 drives the auxiliary fan wheels 4 and 4' to turn, thereby driving axial airflow from upper and lower sides of the casing 1. The incoming upper axial airflow and the incoming lower axial airflow are separated from each other by the annular plate 32 of the primary fan wheel 3, with the airflow transition areas 30 and 30' smoothly changing the incoming upper and lower axial airflows into centrifugal airflows. The radial-flow blades 33 and 33' of the primary fan wheel 3 output a relatively large amount of airs via the side air outlet 12. The overall wind pressure is also increased.

While the principles of this invention have been disclosed in connection with specific embodiments, it should be understood by those skilled in the art that these descriptions are not intended to limit the scope of the invention, and that any modification and variation without departing the spirit of the invention is intended to be covered by the scope of this invention defined only by the appended claims.

What is claimed is:

1. A radial-flow heat-dissipating fan comprising:

a casing including a compartment and a side air outlet, the casing including a side;

a cover mounted to the side of the casing and including an air inlet;

a primary fan wheel rotatably mounted in the compartment, the primary fan wheel including a hub and a plurality of radial-flow blades surrounding the hub of the primary fan wheel; and a separate auxiliary fan wheel mounted in the air inlet of the cover, the auxiliary fan wheel including a hub and a plurality of axial-flow blades, the separate auxiliary fan wheel being attached to the hub of the primary fan wheel;

an airflow transition area being defined between a circumference of the hub of the primary fan wheel, the radial-flow blades of the primary fan wheel, and the axial-flow blades of the auxiliary fan wheel;

the axial-flow blades of the auxiliary fan wheel increasing axial inlet airflow via the air inlet, with the airflow transition area changing a direction of the axial inlet airflow into centrifugal airflow which is outputted via the side air outlet by the radial-flow blades of the primary fan wheel.

2. The radial-flow heat-dissipating fan as claimed in claim 1, with the primary fan wheel and the auxiliary fan wheel being driven by a common motor.

3. The radial-flow heat-dissipating fan as claimed in claim 2, with the hub of the auxiliary fan wheel including a shaft-receiving hole, with the primary fan wheel including a shaft extending through a top face of the hub of the primary fan wheel into the shaft-receiving hole.

4. The radial-flow heat-dissipating fan as claimed in claim 2, with the hub of the primary fan wheel including a reduced section, with the hub of the auxiliary fan wheel including a coupling section engaged with the reduced section.

5. The radial-flow heat-dissipating fan as claimed in claim 1, with the cover including an annular wall formed on a side of the cover and extending from a periphery delimiting the air inlet, and with the auxiliary fan wheel being mounted in the annular wall.

6. The radial-flow heat-dissipating fan as claimed in claim 1, with the primary fan wheel further including an annular plate extending from the hub, with the radial-flow blades of the primary fan wheel being provided on a side of the annular plate.

7. The radial-flow heat-dissipating fan as claimed in claim 6, with the primary fan wheel including a guiding face in a jointing area between the hub and the annular plate.

8. The radial-flow heat-dissipating fan as claimed in claim 6, with the annular plate including a plurality of openings, leaving a plurality of ribs.

9. The radial-flow heat-dissipating fan as claimed in claim 1, with the primary fan wheel including a guiding face in a jointing area between a circumference of the hub and a top face of the hub.

10. The radial-flow heat-dissipating fan as claimed in claim 9, with a bottom of the hub of the auxiliary fan wheel being in contact with the top face of the hub of the primary fan wheel, and with the axial-flow blades of the auxiliary fan wheel facing the guiding face.

11. The radial-flow heat-dissipating fan as claimed in claim 1, with the axial-flow blades of the auxiliary fan wheel extending outward from a top face of the hub of the auxiliary fan wheel to a circumference of the hub of the auxiliary fan wheel.

12. The radial-flow heat-dissipating fan as claimed in claim 1, with the primary fan wheel and the auxiliary fan wheel being respectively driven by two motors.

13. The radial-flow heat-dissipating fan as claimed in claim 12, with the cover including a plurality of ribs extending into the air inlet, with a base being supported by the ribs, and with the motor for driving the auxiliary fan wheel being mounted on the base.

14. The radial-flow heat-dissipating fan as claimed in claim 12, with the cover including a plurality of ribs extending into the casing, with a base being supported by the ribs, and with the motor for driving the auxiliary fan wheel being mounted on the base.

15. The radial-flow heat-dissipating fan as claimed in claim 1, with the casing including another side opposite to the side to which the cover is mounted, further including a second cover and a second auxiliary fan wheel mounted to said another side of the casing, the second cover including an air inlet, the second auxiliary fan wheel including a plurality of axial-flow blades, with the primary fan wheel including an annular plate extending from a circumference of the hub and separating the axial-flow blades of the auxiliary fan wheel from the axial-flow blades of the second auxiliary fan wheel, with the radial-flow blades of the primary fan wheel being formed on a side of the annular plate, further including a plurality of second radial-flow blades formed on another side of the annular plate of the primary fan wheel.

16. The radial-flow heat-dissipating fan as claimed in claim 15, with a guiding face being formed in a jointing area between the hub of the second auxiliary fan wheel and the annular plate of the primary fan wheel.

17. The radial-flow heat-dissipating fan as claimed in claim 15, with the second cover including an annular wall formed on a side thereof and extending from a periphery delimiting the air inlet of the second cover, and with the second auxiliary fan wheel being received in the annular wall on the second cover.

* * * * *